United States Patent [19]

Schaffron

[11] Patent Number: 4,909,779

[45] Date of Patent: Mar. 20, 1990

[54] BAG STACKING MACHINE

[76] Inventor: Helmut T. Schaffron, 9D Harter Ave., P.O. Box 175, Woodland, Calif. 95695

[21] Appl. No.: 237,444

[22] Filed: Aug. 29, 1988

[51] Int. Cl.[4] ..... B31B 1/56

[52] U.S. Cl. ..... 493/235; 493/239; 493/360; 493/437; 493/442; 493/444; 493/445

[58] Field of Search ..... 493/204, 233, 234, 235, 493/357, 360, 343, 436, 437, 444, 445, 442

[56] References Cited

U.S. PATENT DOCUMENTS

| | | | |
|---|---|---|---|
| 2,253,446 | 8/1941 | Spiess | 493/360 |
| 4,197,045 | 4/1980 | Stauber | 414/48 |
| 4,526,565 | 7/1985 | Hummel et al. | 493/196 |
| 4,569,672 | 2/1986 | Marion et al. | 493/444 |
| 4,688,708 | 8/1987 | Irvine et al. | 493/410 |
| 4,725,180 | 2/1988 | Kasamatsu et al. | 414/46 |
| 4,746,108 | 5/1988 | Hirayama et al. | 493/437 |

*Primary Examiner*—Frederick R. Schmidt
*Assistant Examiner*—Jack W. Lavinder
*Attorney, Agent, or Firm*—Julian Caplan

[57] ABSTRACT

A web of flat plastic bag stock formed with transverse perforations and heat seals is separated into individual bags, then individually formed in plural folds and the folded bags are stacked for packaging. To form as many as three folds, four rollers are used. The individual, separated bag is forced between the first and second rolls by a reciprocating first "blade" which contacts the middle of the bag. After being formed with the first fold, the bag is forced between the second and third rolls by a reciprocating second "blade". The twice-folded bag is then forced between the third and fourth rolls by a third reciprocating "blade" and, after the third fold, is conveyed away on belts to a stacking station where plural bags are deposited as a layer on a table. The layers may be packaged by hand or by suitable machinery.

12 Claims, 4 Drawing Sheets

BAG STACKING MACHINE

BACKGROUND OF THE INVENTION

1. Field of the Invention

This invention relates to a new and improved machine for folding and stacking plastic bags preparatory to packaging same. The bags concerned are of the type used for trash and as liners for garbage pails and the like. Such bags are produced from a sleeve of plastic material which enters the machine in the form of a web. By means of transverse heat sealed lines and adjacent transverse perforations, individual bags are defined by the web. In accordance with the disclosure hereinafter set forth, the individual bags are separated from each other, and then formed with transverse folds. The folded bags are conveyed to an assembly station where they are stacked in piles and then delivered to a loading station where they may be manually loaded into packages or may be handled by loading equipment 2. Description of Related Art Conventional practice is to package an elongated section of web so that the consumer is required to separate the web into individual bags. Machinery to fold individual bags is not commonly used.

SUMMARY OF THE INVENTION

The web heretofore described passes vertically downward between snapper rolls which separate the web into individual bags by tearing along transverse perforations. Each bag separately continues vertically downward until its leading edge is sensed as by a photodiode. The middle of the bag is then pushed substantially horizontally inwardly between a pair of continuously rotating first and second rollers by a horizontally reciprocating first blade or pusher. The first and second rollers deliver the once-folded bag rearwardly. Thereupon a second blade or pusher which is vertically reciprocating forces the once-folded bag downward between the second and third rollers. The bag is then delivered forwardly having been folded twice. Thereupon a third pusher or blade pushes the twice-folded bag rearwardly between the third and fourth rollers, thereby performing a third fold. The thrice-folded bag is conveyed rearwardly by a belt conveyor, passed through corrugating rolls and dropped onto a first table, the successive bags accumulating in a stack. When a stack of desired count is accumulated it is dropped onto a second table. Successive stacks are moved rearwardly by a pusher and a plurality of stacks are positioned side by side. When the desired quantity has been thus accumulated, it may be removed manually or by equipment for packaging.

It will be understood that the sequencing of movement of the pushers and blades is computer controlled so that different patterns of folds may be formed depending upon the size of the bags and the wishes of the manufacturer. A sensor senses the approach of the leading edge of the bag as it drops from between the snapper rolls. Thereafter the movement of the various pushers and, consequently, the position at which they engage the bag to initiate the fold is subject to control by means of a program for the computer.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
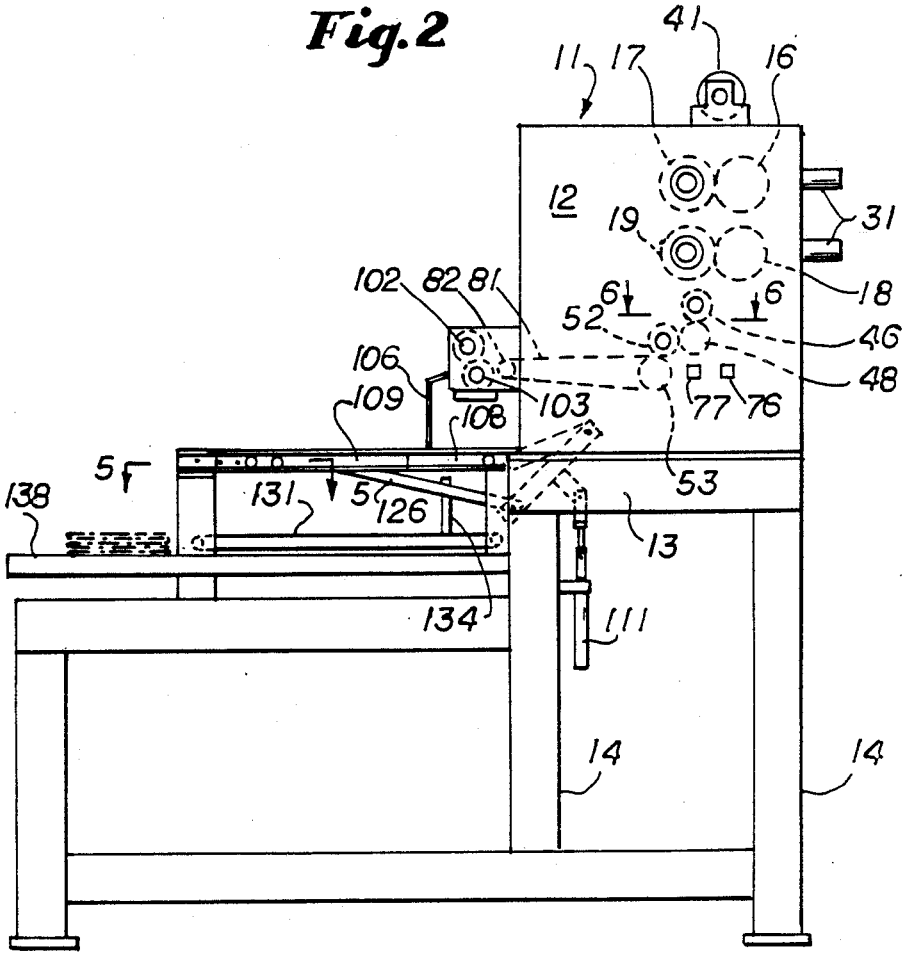
FIG. 1 is a side elevational view of the machine in accordance with the present invention.
Figure 5:
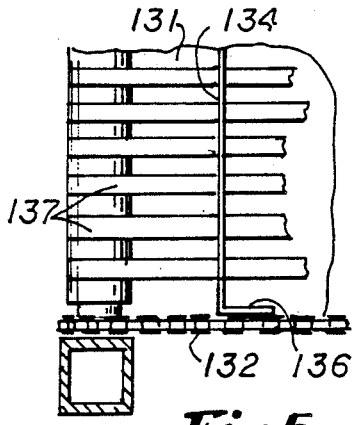
FIG. 5 is a fragmentary enlarged view taken substantially along the line 5—5 of FIG. 1.

As viewed in FIGS. 1 and 2, folding station 11 is at the right side of the machine, which is hereinafter designated the front of the machine. On either side of the machine are vertical sides 12 resting upon horizontal longitudinal supports 13 and horizontal transverse supports 15, all supported by vertical legs 14.

Figure 4:
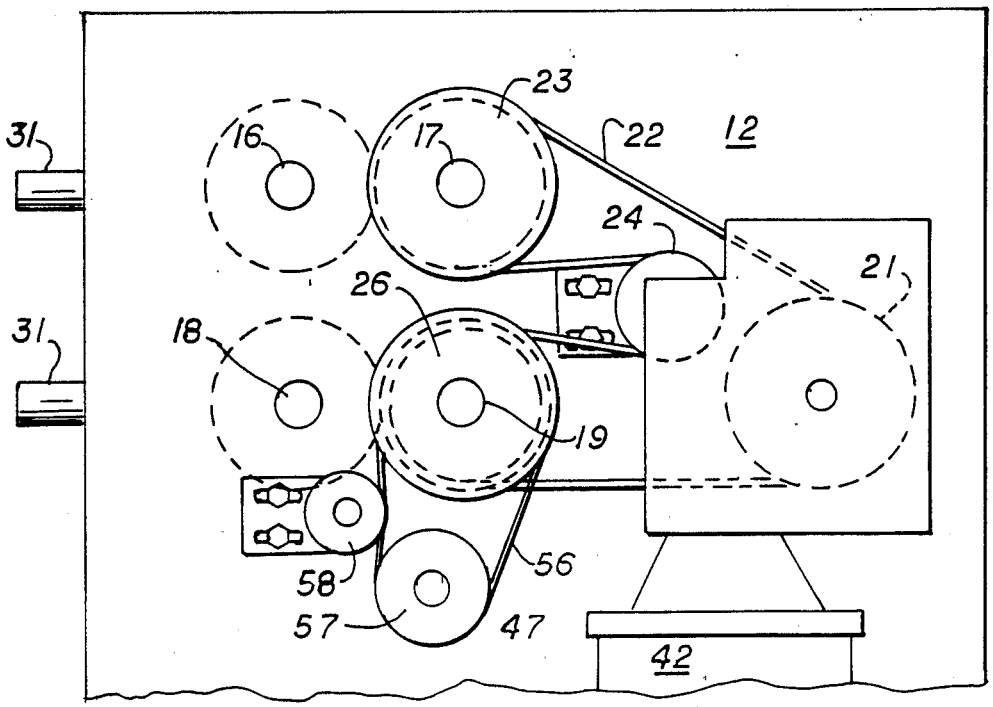
FIG. 4 is a somewhat schematic sectional view taken substantially along the line 4—4 of FIG. 2

Extending between the sides 12 are transverse upper snapper roller 16, upper backing roller 17, lower snapper roller 18 and lower backing roller 19. The rollers 16 and 17 are horizontally opposed, as are the rollers 18 and 19. The rollers 16 and 18 are vertically aligned but spaced apart as are the roller 17 and 19. Directing attention to FIG. 4, the shafts of rollers 17 and 19 are driven from a drive sprocket 21 by means of a sprocket belt 22 which passes over sprocket 23 for the shaft of roller 17, thence forward around idler 24, thence around sprocket 26 for the shaft of roller 19 and back to sprocket 21. It will be apparent from FIG. 4 that the diameter of sprocket 26 is less than that of sprocket 23 and hence that roller 19 rotates more rapidly than roller 17. Roller 16 is driven by friction from roller 17 and roller 18 is driven by friction from roller 19.

Figure 3:
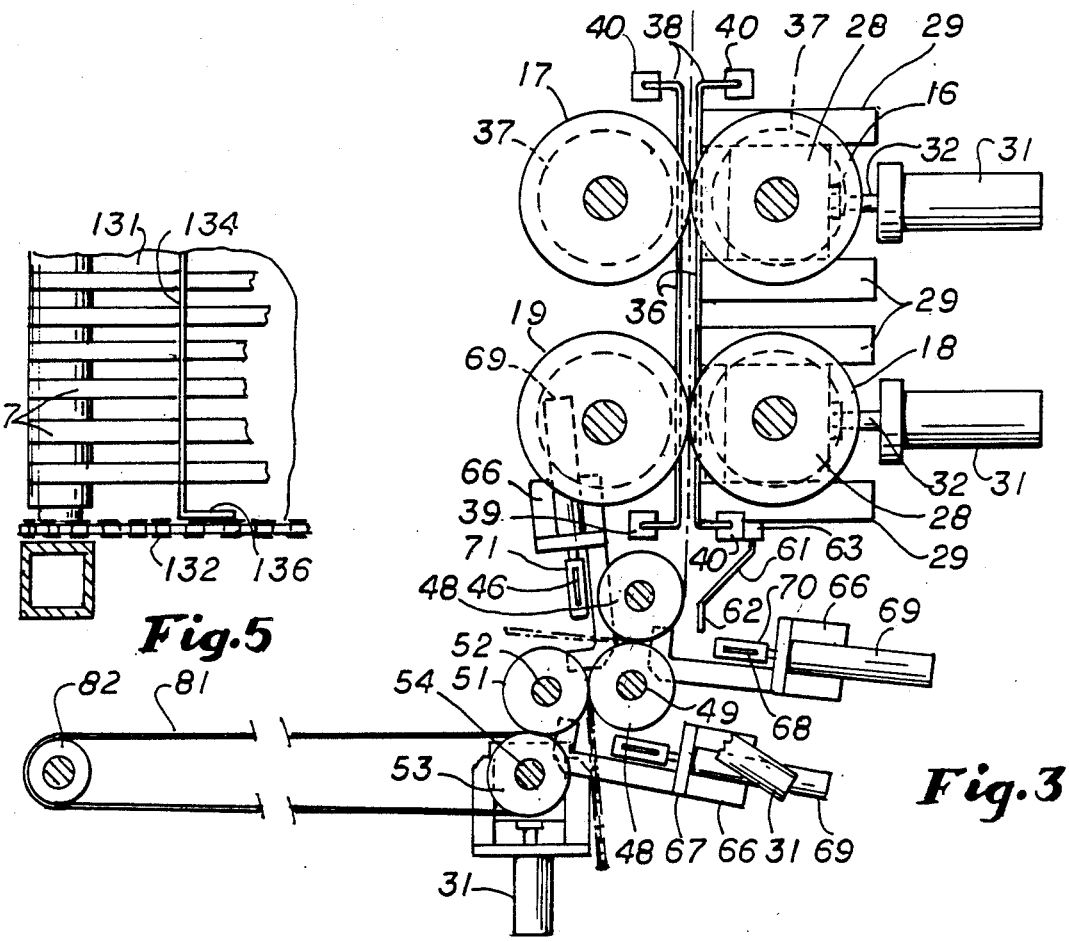
FIG. 3 is an enlarged vertical sectional view taken substantially along the line 3—3 of FIG. 2.

Although not essential for the understanding of the present invention, it may be pointed out as best shown in FIG. 3 that the shaft of roller 16 on either side of the machine is received in a horizontally reciprocating block 28, the edges of which are received in ways 29. Cylinder 31 has a rod 32 which engages the block 28. In case of emergency, such as if the hand of a workman is caught between the rollers, or if the web of material is snarled, the cylinder 31 is energized, which pulls the shaft of roller 16 to the right, as viewed in FIG. 3, thereby alleviating the emergency. The roller 18 is similarly mounted, as is apparent from FIG. 3. In discussing other rollers used in the machine, similar mechanisms are used and the same reference numerals are used to indicate all of the blocks, ways, cylinders and rods.

Directing attention now to FIG. 3, vertical guide rods 36, which are longitudinally spaced apart, extend through grooves 37 formed in the surface of rollers 16–19. The upper ends 38 of rods 36 are bent horizontally and are fixed to transverse bars 40, which are supported by the sides 12. Similarly, the lower ends 39 of rods 36 are fixed to transverse bars 40.

Figure 2:
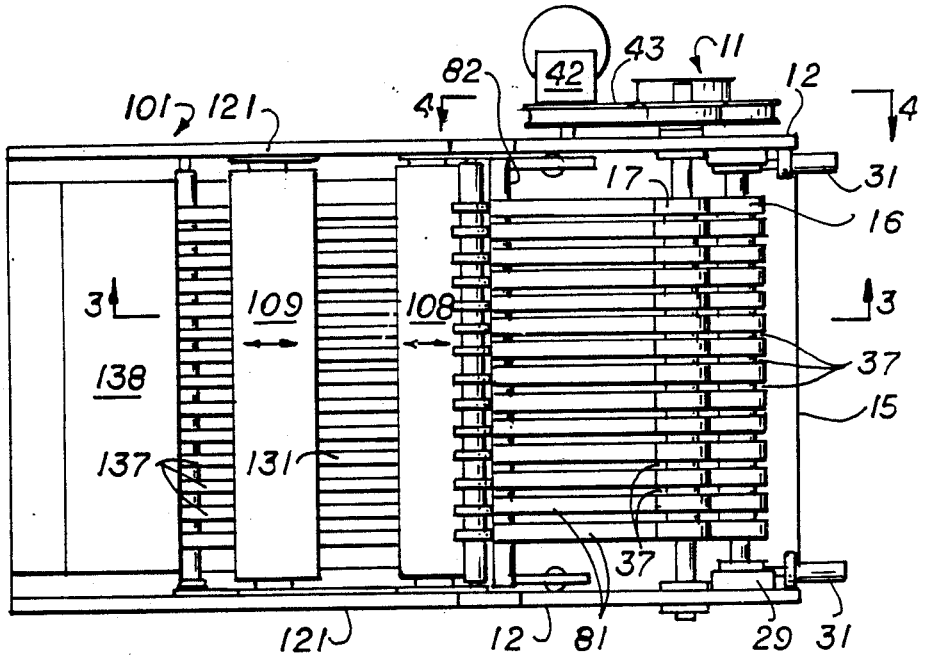
FIG. 2 is a top plan view thereof with certain parts removed for clarity of depiction.

Motor 42, by means of belt 22 (in FIG. 4), drives the shaft of roller 17 (see FIG. 2). Timing of the entire sequence of operation of the various parts of the machine hereinafter described is controlled from rotation of the shaft of motor 42 which is connected by belt 22 to a sprocket on the shaft of roller 17 (see FIG. 4).

Below snapper rollers 18 and 19 are transverse horizontal shafts 47, 49, 52 and 54, which turn first folding roller 46, second folding roller 48, third folding roller 51, and fourth folding roller 53, respectively. Roller 48 is below and somewhat forward of roller 46. Roller 51 is rearward and slightly below roller 48 and roller 53 is below and somewhat rearward of roller 51. Rollers 48, 51 and 53 are driven by friction from roller 46. Shaft 47 is driven from the shaft of lower snapper roller 19 (see FIG. 4) by means of a belt 56 passing around a sprocket (not shown) on the shaft of roller 19 and sprocket 57 on shaft 47. Tightener 58 maintains tightness of belt 56.

Immediately forward of roller 46 depending from transverse bar 63 fixed to sides 12 is a downward forward slanted guide rod 61 having vertical downward stretch termini 62 which are in line with the rearward vertical guide rods 36. Fixed to either of sides 12 are brackets 66. Reciprocating through holes in bracket 66 are the rods 70 of cylinders 69 and connected to the rods 70 is transverse first blade or pusher 68.

Above the level of second folding roller 48 and slightly rearward thereof is second blade 71 which is energized by the same instrumentalities as is blade 68. Blade 71 reciprocates vertically toward the intersections of rollers 48 and 51. Positioned below roller 48 is horizontally upwardly reciprocating third blade 72. The function of blade 68 is to fold and push the fold of a bag between the rollers 46 and 48. The function of the blade 71 is to push the once-folded bag discharged by rollers 46 and 48 downwardly into the intersection of rollers 48 and 51 forming a second fold. The function of the third blade 72 is to push the twice-folded bag forwardly into the intersection of rolls 51 and 53.

To sense the presence of the leading edge of the separated bag which is fed downward by rollers 18 and 19 is a light source 76 fixed rearward of the path of the bags and a photodiode 77 forward of the path of the bag. When the bag intercepts the light from source 76, the diode 77 causes a sequential, computer-controlled energization of the air cylinders 69 which control the blades 68, 71 and 72.

Figure 9A:
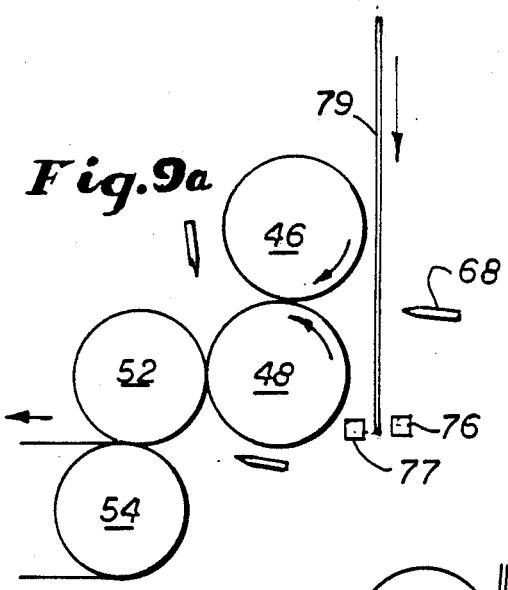
FIGS. 9A through 9G are schematic views showing the sequence of operations in forming three folds in a bag, it being understood that this is merely one of numerous ways in which the bags may be folded.

Turning attention now to the schematics of FIGS. 9A through 9G, as shown in FIG. 9A, when the leading (i.e., the bottom) edge of bag 79 fed downwardly from the snapper rolls intercepts the light from source 76 reaching photodiode 77, the cylinder 69 controlling blade 68 is energized causing the blade 68 to move forwardly (i.e., to the left as viewed in FIGS. 9A and 9B) so that the bag 79 is folded and forced into the intersection of rotating rolls 46 and 48.

Figure 9E:
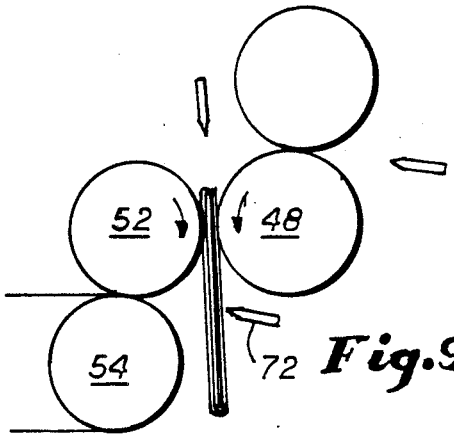
Figure 9B:
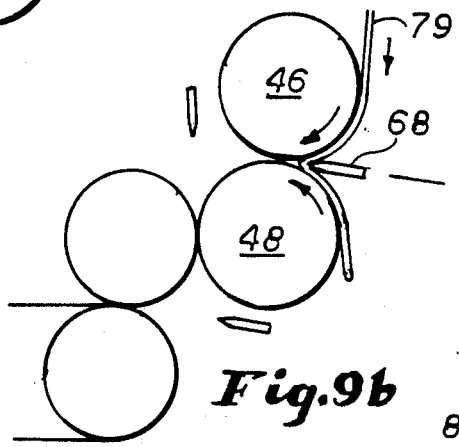
Figure 9F:
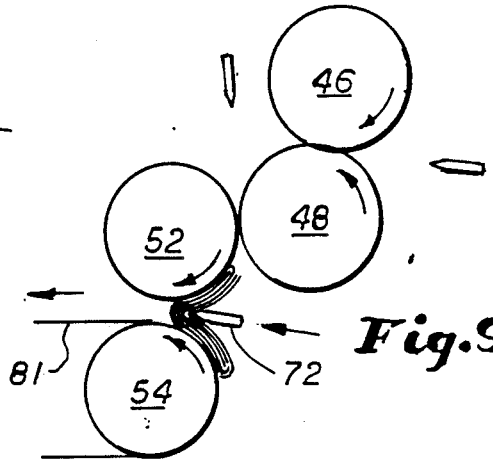
Figure 9C:
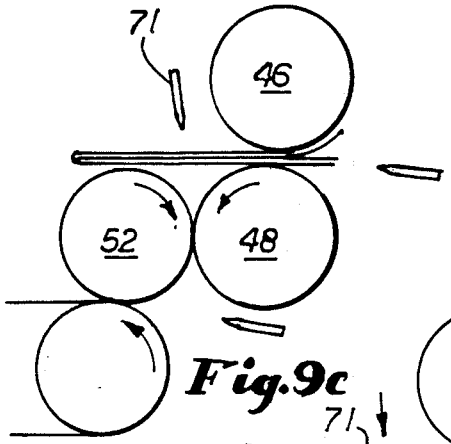

As shown in FIG. 9C, the bag now once folded is discharged from rollers 46 and 48 and timing of the system causes the second blade 71 to move downward, forming a second fold in the bag and forcing the bag between the rollers 48 and 51.

Figure 9G:
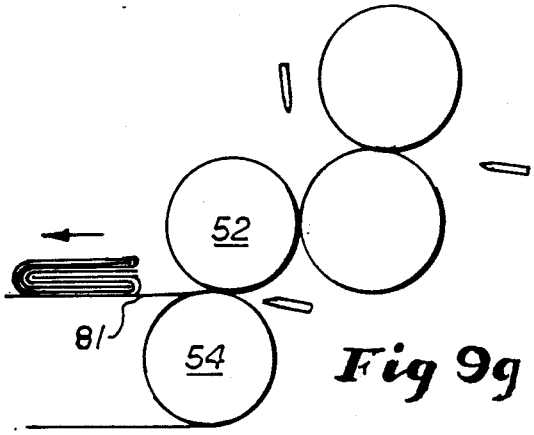
Figure 9D:
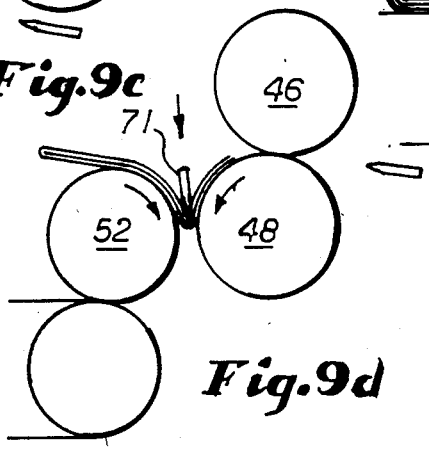

As shown in FIG. 9E, the twice-folded bag is discharged from rollers 48 and 51. In timed sequence, as shown in FIG. 9F, the third blade 72 forms the third fold in the bag and forces it between the rotating rollers 51 and 53. The thrice-folded bag is discharged from rollers 51 and 53 as shown in FIG. 9G and conveyed rearwardly by belts 81.

Figure 8:
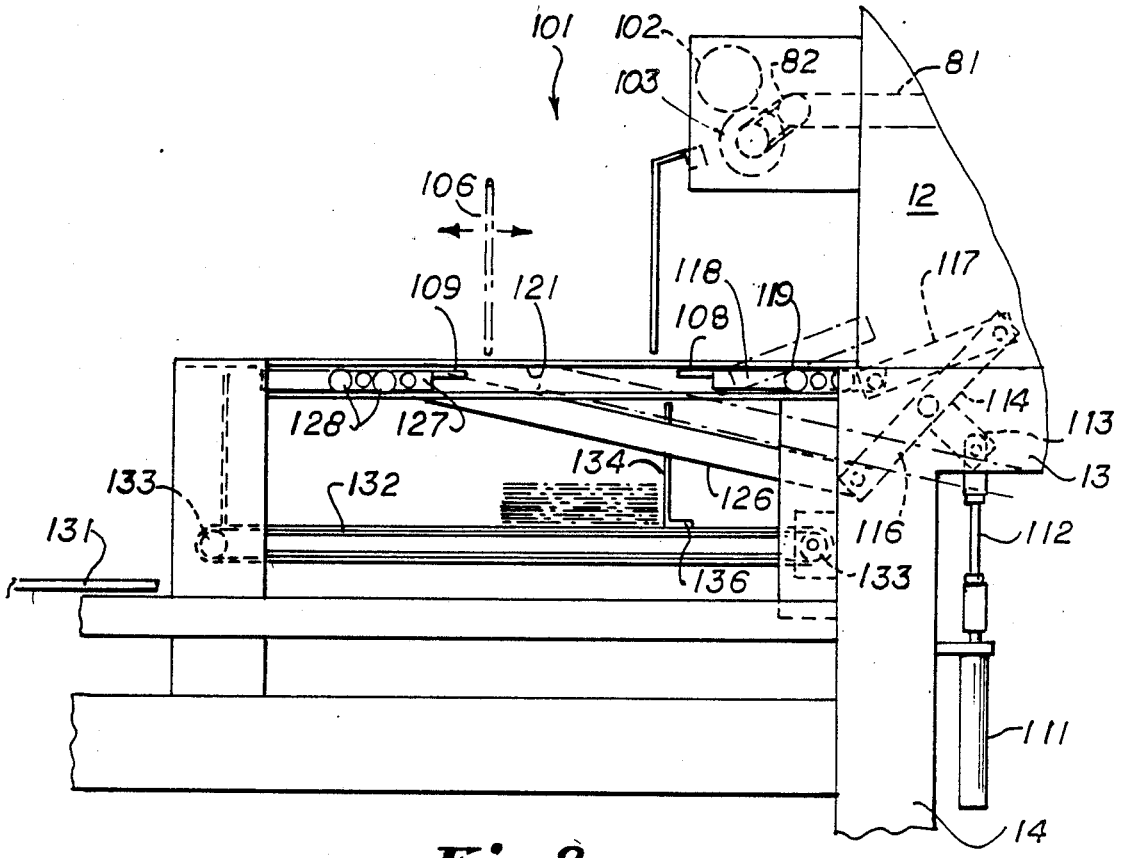
FIG. 8 is an enlarged elevational view of the assembly station of the machine.
Figure 6:
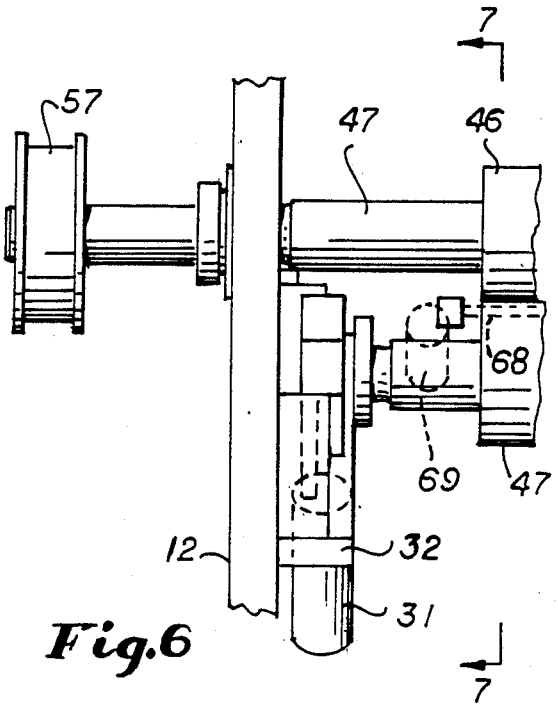
FIG. 6 is an enlarged view taken substantially along the line 6—6 of FIG. 1.
Figure 7:
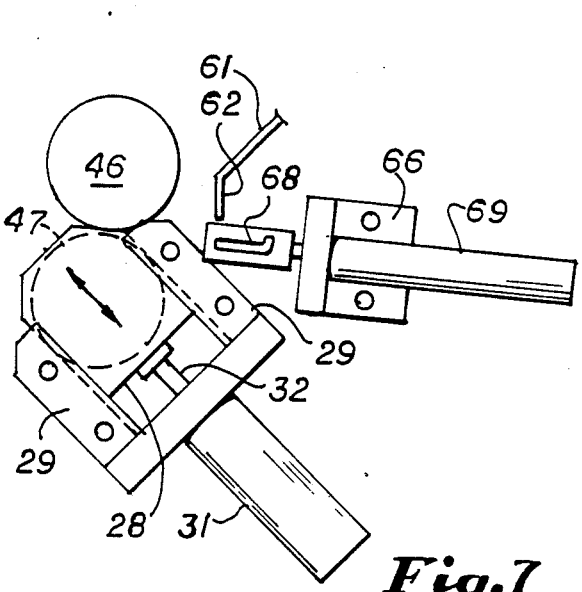
FIG. 7 is a schematic view substantially along the line 7—7 of FIG. 6.

The forward edges of a plurality of horizontally spaced apart belts 81 pass around grooves in roller 53 and are driven thereby, passing around an idler roller 82 (see FIG. 8) at the rearward end of the stretch. Thus the thrice-folded bags are conveyed toward the left of FIG. 3.

Directing attention now particularly to FIGS. 1, 2, 3, 5 and 8, stacking station 101 is illustrated. The folded bags discharged from belts 81 pass between upper and lower corrugating rollers 102, 103 which corrugate the cross-sectional shape of the bags and thus make them stiffer. Roller 103 may be driven in any suitable manner, here shown as being driven by a drive belt 104 connected to idler 82.

The corrugated bags drop off the rollers 102 and 103 and are guided vertically downward by guide rods 106 to rest upon floor plates 108 and 109, the latter being horizontally reciprocating in opposite directions so that when they are subsequently forced apart, the stacked bags drop vertically downward. Vertical cylinder 111 mounted on leg 14 has an upward extending rod 112 pinned to the leg 113 of a T-shaped member having opposed arms 114, 116. Arm 114 is connected by link 117 to a flange 118 formed on the end of floor plate 108. Rollers 119 are attached to flange 118 and slide in horizontal track 121. Thus when the rod 112 is extended, arm 114 pivots counterclockwise, causing floor plate 108 to move to the left, as viewed in FIG. 8—i.e., to contact floor plate 109. It will be understood that in FIG. 8 the floor plates 108 and 109 are shown in retracted position permitting the stack of bags to drop down. Arm 116 is connected by elongated link 126 to flange 127 on floor plate 109. Rollers 128 on flange 127 likewise roll in trackway 121. When the rod 112 is extended, arm 116 turns counterclockwise, pulling link 126 to the right and causing the floor plate 109 to move to the right until it contacts the floor plate 108.

Below floor plates 108 and 109, which may be considered to constitute an upper table, is a lower table 131 which may comprise parallel belts 137. Reciprocating along the sides of the machine at the level of table 131 are roller chains 132. These pass around sprockets 133 at either end and are suitably driven. Pusher 134 at its lower end has a connection 136 which is pinned to links in the sprocket chain 132. The chains 132 cause the pusher 134 to reciprocate, moving a stack of bags to the left, as viewed in FIG. 8, to packing table 138 and moving backwards to a position behind guide rods 106 so that another stack of bags may accumulate. Meanwhile, by means forming no part of the present invention and in fact by manual means if desired, the stacks of bags may be removed and packaged.

What is claimed is:

1. A plastic bag folder, comprising a first folding roll, drive means for continuously rotating said first folding roll, a second folding roll in contact with and driven from said first folding roll, guide means for guiding a bag in a path substantially parallel to a plane through the axes of said first and second folding rolls and in proximity thereto, a first blade having an initial position on the side of said path opposite said folding rolls, first reciprocating means for reciprocating said first blade from said initial position to a second position adjacent the line of tangency of said first and second folding rolls, whereby said first blade pushes said bag transverse to its direction of movement and intermediate its ends, said folding rolls folding said bag along said last-named line, a third folding roll in contact with and driven by said second folding roll and located on the side of said line of tangency of said first and second folding rolls opposite said first blade, said third folding roll being located below a first plane through a second line of tangency of said first and second folding rolls and perpendicular to a second plane through the axes of said first and second folding rolls, a second blade, second reciprocating means for reciprocating said second blade from a first position on a first side of said first plane to a second position adjacent a second line of tangency of said second and third folding rolls, whereby said second blade pushes a bag folded once by said first and second folding rolls toward said second line of tangency, said second and third folding rolls being positioned and rotated to fold said bag along said second line.

2. A bag folder according to claim 1 which further comprises a sensor located adjacent said path beyond said folding rolls, sensing the leading edge of said bag, and means controlled by said sensor for energizing said first and second blades.

3. A bag folder according to claim 2 in which said sensor comprises a photodiode.

4. A bag folder according to claim 1 for use with a web of bags comprising bag separating means along said path ahead of said folding rolls for separating individual bags from said web.

5. A bag folder according to claim 4 in which said web is formed with spaced transverse perforations and said separating means comprises two opposed pairs of snapper rolls and second guide means for guiding said web between said pairs of snapper rolls.

6. A bag folder according to claim 1 which further comprises a fourth folding roll in contact with and driven by said third folding roll, said fourth folding roll being on the side opposite a line through the axes of said second and third folding rolls opposite said first folding roll, a third blade, third reciprocating means for reciprocating said third blade from a first position to a second position adjacent a third line of tangency of said third and fourth rolls, whereby said third blade pushes a bag twice folded by said first, second and third folding rolls toward said third line of tangency, said third and fourth folding rolls folding said bag along a third line.

7. A bag folder according to claim 1 which further comprises a conveyor for conveying away said bag and stacking means at the end of said conveyor opposite said folding rolls.

8. A bag folder according to claim 7 in which said stacking means comprises a table below said remote end and guide means guiding vertical movement of said bags from said conveyor and onto said table.

9. A bag folder according to claim 8 which further comprises corrugating rolls on said remote end of said conveyor for forming corrugations in said folded bags.

10. A bag folder according to claim 9 which further comprises a second table below said first-named table, said first named table comprising a first and a second section divided transversely at the middle and means for reciprocating said sections apart and together to deposit tiers of bags from said first-named table onto said second table.

11. A bag folder according to claim 10 which further comprises a transverse reciprocating pusher on said second table for moving tiers of bags away from said remote end and means for reciprocating said pusher.

12. A bag folder according to claim 1 which further comprises a fourth folding roll parallel to and in contact with and driven by said third folding roll, said fourth folding roll being on the side of a line through the axes of said second and third folding rolls opposite said first folding roll, a third blade, third reciprocating means for reciprocating said third blade from a first position to a second position adjacent a third line of tangency of said third and fourth rolls, whereby said third blade pushes a bag twice folded by said first, second and third folding rolls toward said third line of tangency, said third and fourth folding rolls being positioned and located to fold said bag along a third line, said fourth folding roll being below and displaced slightly farther from said path than said third folding roll.

* * * * *